US011445306B2

(12) United States Patent
Nakagawa et al.

(10) Patent No.: US 11,445,306 B2
(45) Date of Patent: Sep. 13, 2022

(54) METHOD AND APPARATUS FOR ROBUST ACOUSTIC FEEDBACK CANCELLATION

(71) Applicant: Starkey Laboratories, Inc., Eden Prairie, MN (US)

(72) Inventors: Carlos Renato Calcada Nakagawa, Eden Prairie, MN (US); Karim Helwani, Eden Prairie, MN (US); Ivo Merks, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 43 days.

(21) Appl. No.: 15/687,025

(22) Filed: Aug. 25, 2017

(65) Prior Publication Data

US 2018/0063651 A1 Mar. 1, 2018

Related U.S. Application Data

(60) Provisional application No. 62/380,230, filed on Aug. 26, 2016.

(51) Int. Cl.
*H04R 25/00* (2006.01)
*G10K 11/178* (2006.01)
*H04R 3/02* (2006.01)

(52) U.S. Cl.
CPC ..... *H04R 25/453* (2013.01); *G10K 11/178* (2013.01); *G10K 11/17854* (2018.01);
(Continued)

(58) Field of Classification Search
CPC ..... H04R 25/453; H04R 3/02; H04R 25/43; H04R 25/505; G10K 11/17854;
(Continued)

(56) References Cited

U.S. PATENT DOCUMENTS 5,796,849 A * 8/1998 Coleman ..... G10K 11/1784 381/71.11
6,181,794 B1 * 1/2001 Park ..... H04B 3/23 379/406.08

(Continued)

FOREIGN PATENT DOCUMENTS

CN 101635872 1/2010
CN 102026080 4/2011

(Continued)

OTHER PUBLICATIONS

Mazet et al., Background removal from spectra by designing and minimising a non-quadratic function, Apr. 28, 2005, Chemometics and Intelligent Loaboratory Systems, Elsevier Science Publisher, vol. 76, No. 2, pp. 121-133 (Year: 2005).*

(Continued)

*Primary Examiner* — Angelica M McKinney
(74) *Attorney, Agent, or Firm* — Schwegman Lundberg & Woessner, P.A.

(57) ABSTRACT

The present subject matter can improve robustness of performance of acoustic feedback cancellation in the presence of strong acoustic disturbances. In various embodiments, an optimization criterion determined to enhance robustness of an adaptive feedback canceller in an audio device against disturbances in an incoming audio signal can be applied such that the adaptive feedback canceller remains in a converged state in response to presence of the disturbances.

20 Claims, 6 Drawing Sheets

(52) U.S. Cl.
CPC ..... *H04R 3/02* (2013.01); *H04R 25/43* (2013.01); *H04R 25/505* (2013.01); *G10K 2210/108* (2013.01)

(58) Field of Classification Search
CPC ..... G10K 2210/108; G10K 11/178; G10K 11/175; H04M 9/082; H04B 3/23
See application file for complete search history.

(56) References Cited

U.S. PATENT DOCUMENTS

| | | | | |
|---|---|---|---|---|
| 6,185,300 | B1 * | 2/2001 | Romesburg | H04M 9/082 379/406.09 |
| 6,377,682 | B1 | 4/2002 | Benesty et al. | |
| 6,947,549 | B2 | 9/2005 | Yiu et al. | |
| 7,072,465 | B1 * | 7/2006 | Benesty | H04B 3/234 370/286 |
| 7,155,022 | B2 * | 12/2006 | Danielsen | H04R 25/554 381/318 |
| 8,175,290 | B2 * | 5/2012 | Haulick | H04M 9/082 381/93 |
| 8,379,894 | B2 * | 2/2013 | Klinkby | H04R 25/453 381/318 |
| 8,594,354 | B2 * | 11/2013 | Klinkby | H04R 25/356 381/318 |
| 8,625,775 | B2 * | 1/2014 | Bhaskar | H04M 9/082 379/406.01 |
| 8,831,210 | B2 | 9/2014 | Kumar | |
| 8,917,891 | B2 | 12/2014 | Natarajan | |
| 9,269,343 | B2 * | 2/2016 | Munk | H04R 3/02 |
| 9,704,471 | B1 * | 7/2017 | Ku | G10K 11/17854 |
| 2001/0002930 | A1 * | 6/2001 | Kates | H04R 25/453 381/317 |
| 2002/0032004 | A1 * | 3/2002 | Widrow | H04B 3/36 455/22 |
| 2004/0057574 | A1 * | 3/2004 | Faller | H04M 9/082 379/387.01 |
| 2004/0264706 | A1 | 12/2004 | Ray et al. | |
| 2010/0232632 | A1 * | 9/2010 | Kindred | H04R 3/02 381/315 |
| 2011/0150257 | A1 * | 6/2011 | Jensen | H04R 25/453 381/318 |
| 2011/0249846 | A1 * | 10/2011 | Natarajan | H04R 25/453 381/318 |
| 2011/0249847 | A1 * | 10/2011 | Salvetti | H04R 25/453 381/318 |
| 2011/0261950 | A1 * | 10/2011 | Yamaguchi | H03H 21/0027 379/406.08 |
| 2013/0156223 | A1 * | 6/2013 | Huang | H04R 3/02 381/93 |
| 2014/0185849 | A1 * | 7/2014 | Ma | H04R 25/453 381/318 |
| 2014/0348361 | A1 * | 11/2014 | Theverapperuma | H04R 25/453 381/318 |
| 2017/0078804 | A1 * | 3/2017 | Guo | H04R 25/453 |
| 2017/0311091 | A1 | 10/2017 | Nakagawa | |
| 2019/0132686 | A1 * | 5/2019 | Kuriger | H04R 25/505 |

FOREIGN PATENT DOCUMENTS

| | | |
|---|---|---|
| CN | 103475980 | 12/2013 |
| WO | WO-2015044915 A1 | 4/2015 |

OTHER PUBLICATIONS

Mazet et al., Background removal from spectra by designing and minimising a non-quadratic function, Apr. 28, 2005, Chemometics and Intelligent Laboratory Systems, Elsevier Science Publisher, vol. 76, No. 2, pp. 121-133 (Year: 2005).*
Mazet et al., Background removal from spectra by designing and minimising a non-quadratic function, Apr. 28, 2005, Chemometics and Intelligent Laboratory Systems, Elsevier Science Publisher, vol. 76, No. 2, pp. 12-133. (Year: 2005).*
"European Application Serial No. 17188032.1, Extended European Search Report dated Nov. 21, 2017", 10 pgs.
Bello, J.P., et al., "A tutorial on onset detection in music signals", IEEE Trans. Speech Audio Process., vol. 13, No. 5, (2005), 1035-1047.
Bishop, Christopher M., "Pattern Recognition and Machine Learning", Chapter 2-Probability Distributions In Publication of Information Science and Statistics, Springer, (2006), 72 pgs.
Buchner, Herbert, et al., "Robust extended multidelay filter and double-talk detector for acoustic echo cancellation", IEEE Transactions on Audio, Speech, and Language Processing, vol. 14, No. 5, (Sep. 2006), 1633-1644.
Forssell, Urban, et al., "Closed-loop identification revisited", Automatica, vol. 35, No. 7, (Jul. 1999), 1215-1241.
Gansler, T., "Double-Talk Robust Fast Converging Algorithms for Network Echo Cancellation", Proc. 1999 IEEE Workshop onilppliculions ofsignal Processing to Audio and Acoustics, NewPallz, New York, Oct. 17-20, 1999; 215-218, (Jan. 1, 1999), 5 pgs.
Guo, Meng, et al., "On the Use of a Phase Modulation Method for Decorrelation in Acoustic Feedback Cancellation", 20th European Signal Processing Conference (EUSIPCO 2012), (2012), 2000-2004.
Helwani, Karim, et al., "Multichannel Adaptive Filtering with Sparseness Constraints", International Workshop on Acoustic Signal Enhancement, Sep. 4-6, 2012, Aachen, (2012), 4 pgs.
Huber, P.J., et al., "Robust Statistics", Ch, 3, 5 & 6, (2009).
Huo, Jiaquin, et al., "A robust transform domain echo canceller employing a parallel filter structure", Signal Processing 86 (2006), (2006), 3752-3760.
Mazet, V, et al., "Background removal from spectra by designing and minimising a non-quadratic cost function", Chem0metrics and Intelligent Laboratory Systems, Elsevier Science Publishers B.V. Amsterdam, NL, vol. 76, No. 2, (Apr. 28, 2005), 121-133.
Rombouts, G, et al., "Robust and efficient implementation of the PEM-AFROW algorithm for acoustic feedback cancellation", Journal of the Audio Engineering S0C, Audio Engineering Society, New York, NY, US, vol. 55, No. 11; 955-966, (Nov. 1, 2007), 13 pgs.
Shynk, John J., "Frequency-Domain and Multirate Adaptive Filtering", IEEE SP Magazine; pp. 15-37, (Jan. 1992), 24 pgs.
Spriet, A., et al., "Adaptive feedback cancellation in hearing aids", Journal of the Franklin Institute 343 (2006) 545-573, (2006), 29 pgs.
"Chinese Application Serial No. 201710752170.9, Office Action dated Jul. 15, 2019", W English Translation, 25 pgs.
"Chinese Application Serial No. 201710752170.9, Office Action dated May 6, 2020", with English translation, 21 pgs.
"Chinese Application Serial No. 201710752170.9, Response filed Jul. 21, 2020 to Office Action dated May 6, 2020", w/ English Claims, 17 pgs.
"Chinese Application Serial No. 201710752170.9, Office Action dated Dec. 1, 2020", with English Translation, 11 pgs.
"Chinese Application Serial No. 201710752170.9, Response filed Feb. 10, 2021 to Office Action dated Dec. 1, 2020", w / English claims & machine translation, 19 pgs.

* cited by examiner

METHOD AND APPARATUS FOR ROBUST ACOUSTIC FEEDBACK CANCELLATION

CLAIM OF PRIORITY

This application claims the benefit of priority under 35 U.S.C. § 119(e) of U.S. Provisional Patent Application Ser. No. 62/380,230, filed on Aug. 26, 2016, which is herein incorporated by reference in its entirety.

TECHNICAL FIELD

This document relates generally to audio systems and more particularly to an acoustic amplification device with robust acoustic feedback cancellation.

BACKGROUND

Hearing devices provide sound for the wearer. Some examples of hearing devices include headsets, hearing aids, speakers, cochlear implants, bone conduction devices, and personal listening devices. Hearing aids provide acoustic amplification to compensate for hearing loss by transmitting amplified sounds to the wearer's ear canals. In various examples, a hearing aid is worn in and/or around a wearer's ear.

Devices that perform acoustic amplification suffer from acoustic feedback and requires acoustic feedback cancellation to achieve higher gain margins. However, conventional adaptive feedback cancellation algorithms suffer in the presence of disturbances and outliers, which are caused mainly by sudden changes in the signal statistics or strong deviation of the background noise from being normally distributed.

SUMMARY

The present subject matter can improve robustness of performance of acoustic feedback cancellation in the presence of strong acoustic disturbances. In various embodiments, an optimization criterion determined to enhance robustness of an adaptive feedback canceller in an audio device against disturbances in an incoming audio signal can be applied such that the adaptive feedback canceller remains in a converged state in response to presence of the disturbances.

In various embodiments, an audio device can include a microphone to receive an input sound and to produce a microphone signal representative of the received sound, an audio processing circuit configured to process the microphone sound to produce a loudspeaker signal, and a loudspeaker configured to produce an output sound using the loudspeaker signal. The audio processing circuit includes an adaptive feedback canceller that can be configured to cancel acoustic feedback in the microphone signal and be configured to be updated by applying an optimization criterion determined to enhance robustness against disturbances in the microphone signal, such that the adaptive feedback canceller remains convergent in the presence of the disturbances. In various embodiments, the audio device can be a hearing device, such as a hearing aid configured to compensate for hearing impairment. In one embodiment, the audio processing circuit is configured to detect onsets of the microphone signal and to halt an adaptation process of the adaptive feedback canceller in response to each detection of the onsets.

This summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
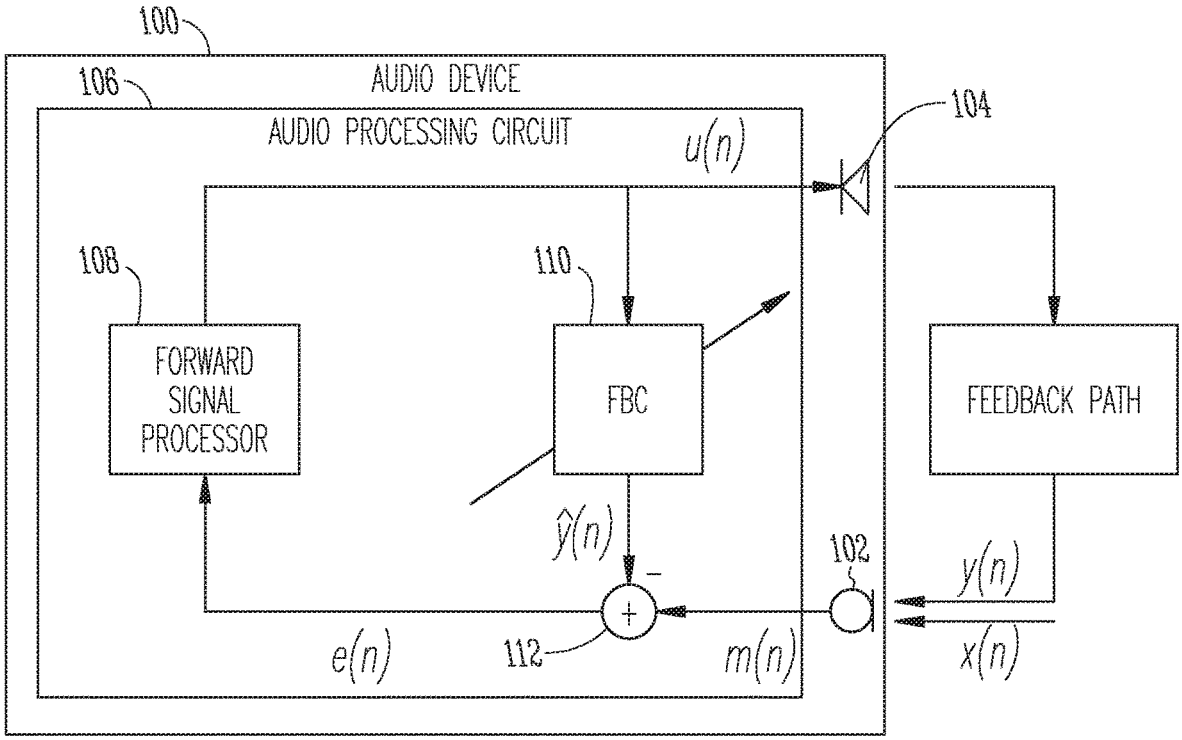
FIG. 1 is a block diagram illustrating an embodiment of an audio device with adaptive feedback cancellation in a sound system.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter improves the overall performance of acoustic feedback cancellation that can be used in a variety of audio devices, including but not limited to headsets, speakers, personal listening devices, headphones, hearing aids and other types of hearing devices. It is understood that other hearing devices not expressly stated herein may be used in conjunction with the present subject matter. In embodiments employing adaptive feedback cancelers, the present subject matter enhances the operation of the adaptive feedback canceller.

In various embodiments, the present subject matter improves the performance of the adaptive feedback canceller in a device by making it robust against outliers, such as incoming signal onsets and variations of the incoming signal statistics, thus maintaining the converged state of the feedback canceller in the presence of strong disturbances. This improves overall performance of the feedback canceller in terms of maintaining and achieving higher added stable gains and less audible artifacts.

Adaptive feedback cancellation algorithms suffer in the presence of strong disturbances, such as during onsets of incoming signal (impulses, speech, music, noise, etc.). The incoming signal autocorrelation introduces a bias term to the feedback estimate, but a large amount of variance will still result depending on the feedback-to-incoming-signal ratio (FSR) and variations to the incoming signal statistics. From the feedback cancellation perspective, the feedback signal is the signal of interest, whereas the incoming signal (impulses, speech, music, noise, etc.) is considered as measurement noise to the identification process. This is discussed in, for example, Rombouts et al., "Robust and Efficient Implementation of the PEM-AFROW Algorithm for Acoustic Feedback Cancellation," *J Audio Eng: Soc.,* 2007, which is incorporated herein by reference in its entirety.

During low FSR the variance will be high (e.g. during signal onsets). During onsets, the microphone signal is almost completely a disturbance to the adaptation process as it takes some time for the incoming signal to travel through the system and return to the microphone as feedback. Hence, during strong disturbances the adaptive filter diverges resulting in performance degradation leading to lower added stable gains, audible artifacts, and even instabilities.

Variations to the incoming signal statistics will also cause the adaptive filter to diverge. The convergence of typical adaptive filtering algorithms is proven assuming a stationary input signal. Many signals can be treated as short-time stationary. However, the transition between stationarity periods leads to outliers in the error signal, resulting in local divergence of the adaptive filter.

The present subject matter enables the feedback canceller to be robust against outliers, such as incoming signal (impulses, speech, music, noise, etc.) onsets and variations to the incoming signal statistics. This is different from solving a bias problem. The present approach reduces the variance of the adaptive feedback canceller.

Outliers, such as strong disturbances (e.g., onsets, bursts), caused by incoming signal (impulses, speech, music, noise, etc.) onset and variation to its statistics poses a challenge to traditional adaptive feedback cancellation algorithms that are based on least-squares error (LSE) or mean-squared error (MSE) During such conditions, the adaptive filter diverges leading to lower added stable gains, audible artifacts, and potentially even instabilities.

FIG. 1 is a block diagram illustrating an embodiment of an audio device 100 with adaptive feedback cancellation in a sound system where x(n) is the incoming signal and y(n) is the feedback signal. The incoming signal x(n) (such as impulses, speech, music, noise, etc.) is picked up by a microphone 102 (which produces a microphone signal m(n)), modified by an audio processing circuit 106 including a forward signal processor 108, played out through a receiver (loudspeaker) 104 as u(n), and then picked up again by microphone 102 as a feedback signal, via a feedback path. An adaptive feedback canceller (FBC) 110 produces a feedback estimate signal $\hat{y}(n)$, which is subtracted from m(n) to produce an error signal e(n) by an adder 112 to be processed by forward signal processor 108 to produce u(n). There is a delay between the incoming signal onset and when it is picked again as feedback by microphone 102. This delay is proportional to the forward processing latency and the length of the feedback path. The FSR can be defined as the ratio of the energy of the feedback signal to the energy of the incoming signal:

$$FSR = \frac{E\{y^2(n)\}}{E\{x^2(n)\}}.$$

Figure 2:
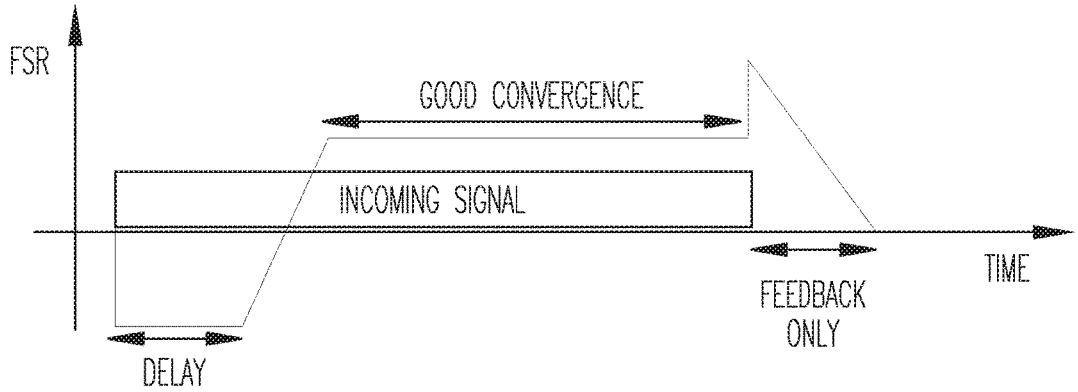
FIG. 2 is a graph illustrating an example of feedback-to-incoming-signal ratio (FSR) in the feedback cancellation as illustrated in FIG. 1.

FIG. 2 is a graph illustrating an example of FSR in the feedback cancellation as illustrated in FIG. 1. To illustrate the problem of FBC divergence, the graph shows how the FSR varies during incoming signal (such as impulses, speech, music, noise, etc.) onsets. At the incoming signal onsets, the FSR is low. During these times, only the incoming signal is present (as a strong disturbance). After a short period of time, feedback, resulting from the incoming signal, is picked up by microphone 102 and the FSR is increased. Finally, the incoming signal stops and, for a very short period of time, only feedback is present and the FSR peaks. During times of good FSR, the FBC convergence is good. During times with poor FSR, the noise/disturbance is large and the FBC diverges. This divergence results in performance degradation of the FBC', 110, leading to lower added stable gains, audible artifacts, and even instabilities. This problem is also discussed, for example, in Rombouts et al.

The same analysis can be employed when there is a change to the incoming signal statistics. The problem with changes to the incoming signal statistics is exacerbated if decorrelation methods that are signal dependent is employed, such as, the prediction error method (PEM) found in Spriet et al., "Adaptive feedback cancellation in hearing aids," *J. Franklin Inst.*, vol. 343, no. 6, pp. 545-573, September 2006, which is incorporated by reference herein in its entirety.

PEM is used in feedback cancellation to address bias problem (also known as entrainment). Prediction error filters whiten the error signal based on a model of the signal statistics, thus reducing or removing the bias problem. If such model is incorrect, then the performance of the FBC is degraded. Thus, when there is a sudden change to the incoming signal statistics, the prediction error filter needs some time to re-converge. At such times, the prediction error filter divergence causes the FBC to further diverge as a result of the added bias. Various embodiments of the present subject matter have an added benefit that gives the prediction error filters enough time to adapt to the new signal statistics without causing the feedback canceler to diverge. That is, these embodiments make the FBC robust against variations to incoming signal statistics and also reduce the added bias term from a diverged prediction error filter.

Various studies have shown that robustness signifies insensitivity to a certain amount of deviations from statistical modeling assumptions due to some outliers. Such studies are discussed in, for example, the following documents: Huber et al, *Robust Statistics*, vol. 523, no. 3, 2009; Gansler et at, "Double-talk robust fast converging algorithms for network echo cancellation," *IEEE Trans. Speech Audio Process.*, vol. 8, no. 6, pp. 656-663, 2000; Buchner et al, "Robust extended multidelay filter and double-talk detector for acoustic echo cancellation," *IEEE Trans, Audio, Speech Lang. Process.*, vol. 14, no. 5, pp. 1633-1644, September 2006; Murphy, *Machine Learning: A Probabilistic Perspective.* 2012.; and Bishop, *Pattern Recognition and Machine Learning*, vol. 4, no. 4. 2006, all of which are incorporated herein by reference in their entireties. The sensitivity to outliers increases with the convergence speed of the adaptation algorithm and limits the performance of signal processing algorithms, especially when fast convergence is required such as in feedback cancellation.

The convergence of typical adaptive filtering algorithms is proven assuming a stationary input signal. Many signals can be treated as short-time stationary. However, the transition between stationarity periods leads to outliers in the error signal, resulting in local divergence of the adaptive filter. The present subject matter addresses such problems resulting from the outliers.

In various embodiments, robustness to outliers can be achieved with modification to the cost function to be minimized. Feedback cancellation methods generally aim at minimizing the square of the error (residuals). This is analogous to regression models using a Gaussian distribution with zero mean and constant variance that decorrelation methods may be required for this solution to deal with the bias problem, e.g. prediction error method, phase modulation, etc.). However, if there are outliers in the data, this can result in a poor fit, as demonstrated in, for example, Murphy. The squared error penalizes deviations quadratically, so points further from the true function have more effect on the fit than points near to the true function to be estimated.

One way to achieve robustness is to replace the Gaussian distribution for the response variable with a distribution that has heavy tails such as the Student t- and the Laplace distributions, as discussed, for example, in Murphy and Bishop. Examples of such non-quadratic cost functions, such as the Huber loss function, may be employed, as discussed in Gansler et al. and Buchner et al. This is applied to the acoustic echo cancellation to handle double-talk situations, as discussed, for example, in Gansler et al. and Buchner et al. This is typically applied on a real (i.e., not complex) error signal. In the case of a complex error signal, as in subband based implementations, the $l_1$ norm can be approximated by an upper bound given by the sum of the $l_1$ norm value of the real part and the norm value of the imaginary part.

In various embodiments, a more general approach involves using a variant $l_p$ norm optimization criterion, as discussed in Helwani et al., "Multichannel Adaptive Filtering with Sparseness Constraints," *Int. Work. Acoust. Signal Enhanc.*, no. September, pp. 4-6, 2012, which is hereby incorporated by reference in its entirety. Various embodiments even minimize a piecewise function of the error signal, for instance, minimize a $l_2$-norm if this function is under some threshold or an $l_p$-norm otherwise. This should generalize the problem to include complex error/residual signals such as in the subband/weighted overlap add (WOLA) domain.

The present subject matter changes optimization criterion in the context of acoustic feedback cancellation. As such, the FBC can be made robust against onsets and strong disturbances (e.g. signal onsets and variations to its statistics). Some embodiments are discussed below, with some of simulation results shown in FIGS. 3 and 4 to demonstrate their advantages.

One embodiment uses a partitioned block frequency domain adaptive filter (PBFDAF). The prediction error method (PEM) is used to whiten the error signal and reference signals prior to updating the FBC, thereby removing or reducing the bias problem. A path change occurs half way through the simulation. One example of a general configuration for the PBFDAF is provided in Spriet et al. (2006). The error (residual) signal is computed in the time domain and is real (i.e., not complex). In various other embodiments, the FBC update occurs in the frequency domain.

A modified adaptive filter, which minimizes the median of the error signal (instead of the mean square error), is used. This results in a $l_1$ norm instead of a $l_2$ norm minimization, Other embodiments may generalize to $l_p$ norms. This can also be thought as constraining the error signal prior to updating the adaptive filter.

Figure 3:
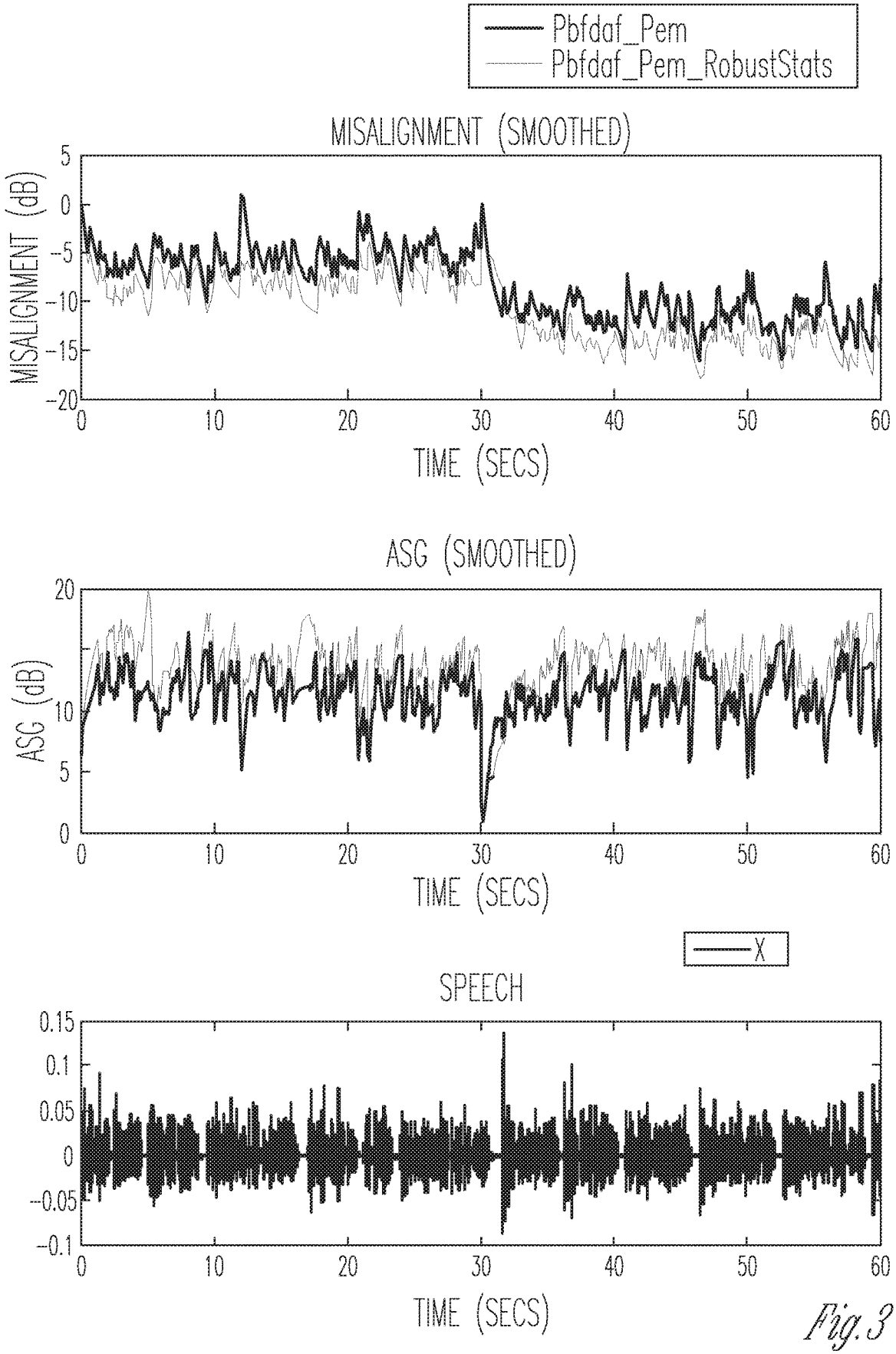
FIG. 3 shows simulation results demonstrating performance of an embodiment of feedback cancellation, with incoming signal being speech.
Figure 4:
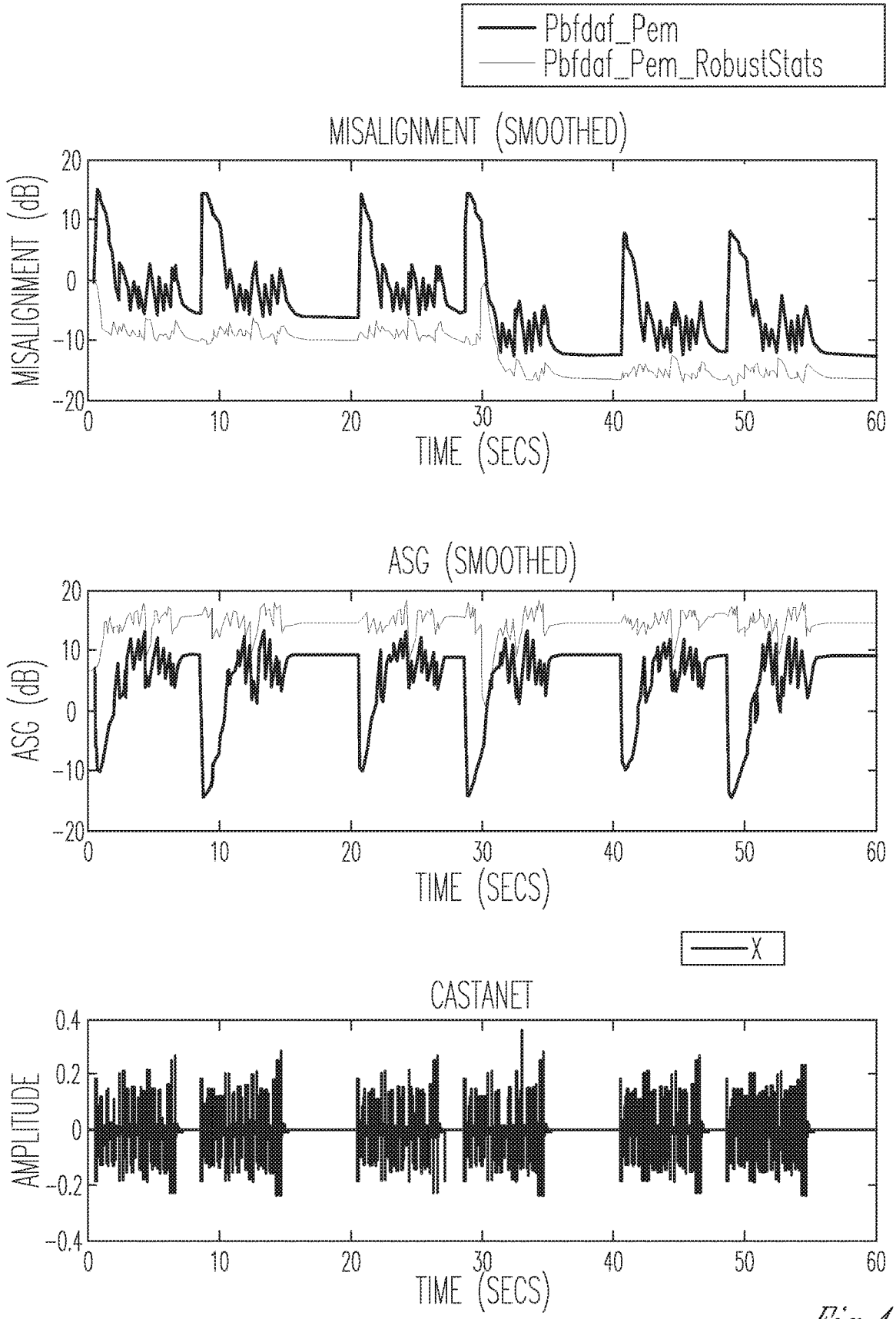
FIG. 4 shows simulation results demonstrating performance of an embodiment of feedback cancellation, with incoming signal been castanet instrument.

FIGS. 3 and 4 present the misalignment (normalized distance between the true and estimated feedback path—lower values better), added stable gain (ASG, amount of gain added to the system by having the FBC—higher values better), and the incoming signal (speech in FIG. 3, or castanet instrument showing strong onsets in FIG. 4). In FIGS. 3 and 4, "Pbfdaf_Pem_PobustStats" corresponds to robust FBC update, and "Pbfdaf_Pem" corresponds to non-robust normalized least mean square (NLMS) update.

These results demonstrate that the FBC can be made more robust to signal onsets, more evident when the incoming signal contains strong and sharp onsets (as shown in FIG. 4, when the incoming signal is a castanet percussion instrument). The robust FBC does not diverge from its current solution as much as the non-robust counterpart. This maintains the FBC's converged state resulting in overall performance improvement, whereas the non-robust version diverges, introducing audible artifacts and instabilities.

In one embodiment, an ad hoc, empirical approach compares an instantaneous level of an incoming signal to a threshold. This threshold can be computed by scaling the average of the incoming signal. If the instantaneous value of the incoming signal is greater than this threshold, then an onset is detected and the FBC adaptation halted for some time. In another embodiment, incoming signal onsets are detected using the second derivative of the signal phase, such as discussed in Bello, et al., "A tutorial on onset detection in music signals," *IEEE Trans. Speech Audio Process.*, vol. 13, no. 5, pp. 1035-1046, 2005, which is hereby incorporated by reference in its entirety. Yet another embodiment for detecting incoming signal onsets and halting the FBC adaptation is provided by U.S. patent application Ser. No. 15/133,910, filed Apr. 20, 2016, which is incorporated by reference herein in its entirety.

In various other embodiments, detection of onsets in the incoming signal is not needed. The FBC is also robust against outliers in general other than just signal onsets. In these embodiments, the adaptation process does not need to be halted. In some embodiments and applications; halting the adaptation process may be highly undesirable.

A modification of a non-quadratic regression approach may be employed. One example is the modification of the $l_1$ norm minimization or the Huber loss function as provided in Huber et al. The approach is modified for use in feedback cancellation to make it robust against disturbances, such as, incoming signal onsets and changes to its statistics. In various embodiments, an extension from the $l_1$ and $l_2$ norm minimization to a more general to $l_p$ norm may be employed.

Figure 5:
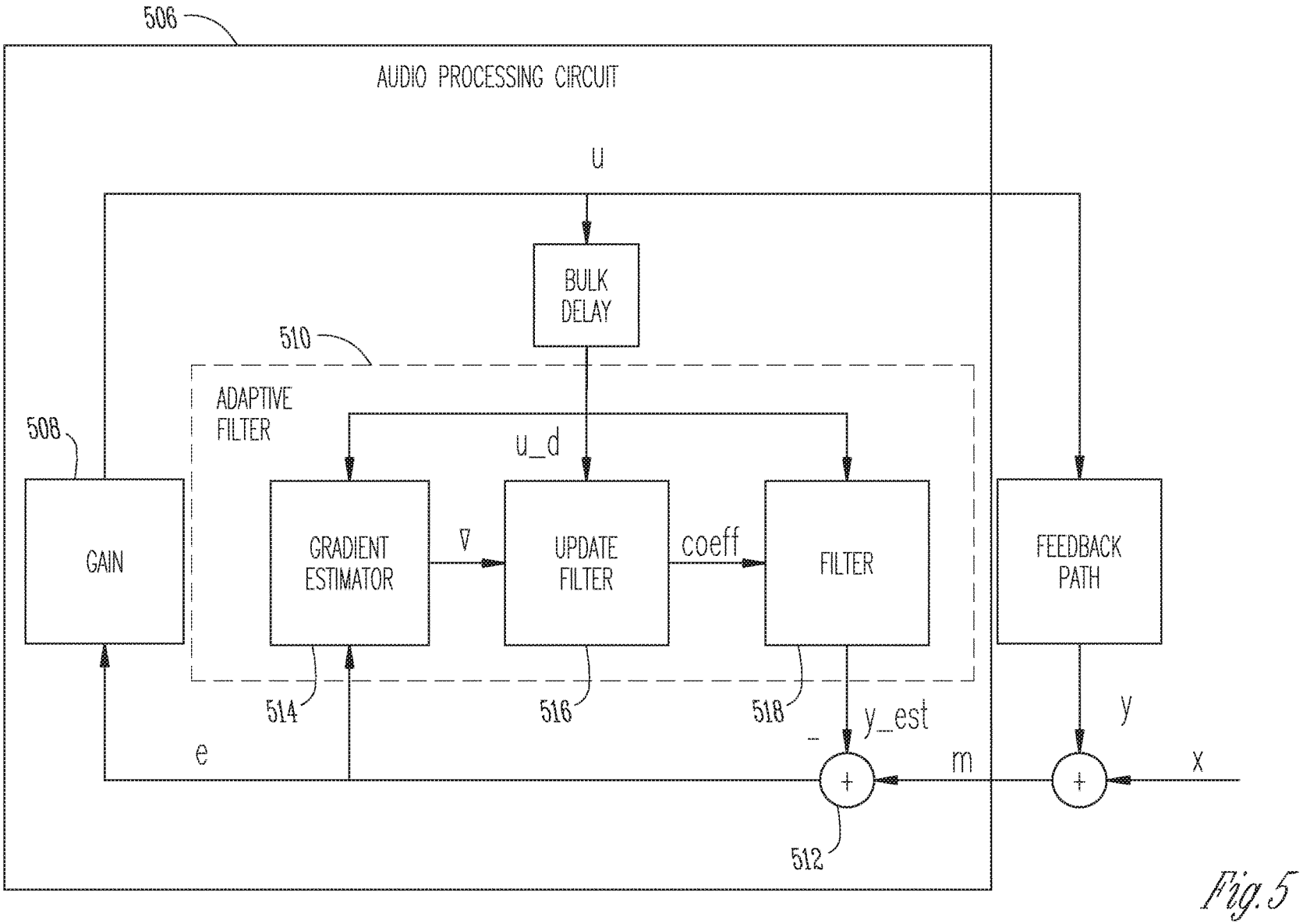
FIG. 5 is a block diagram illustrating an embodiment of an audio processing circuit with adaptive feedback cancellation in a sound system, showing an adaptive filter.

FIG. 5 is a block diagram illustrating an embodiment of an audio processing circuit 506 with adaptive feedback cancellation in a sound system, showing an adaptive filter 510. Audio processing circuit 506 represents an example of audio processing 106. Signals labeled in FIG. 5 include:

u: loudspeaker signal (corresponding to u(n) in FIG. 1);
u_d: delayed loudspeaker signal;
y: feedback signal (corresponding to y(n) in FIG. 1);
y_est: feedback estimate (corresponding to $\hat{y}(n)$ in FIG. 1
x: incoming signal (corresponding to x(n) in FIG. 1);
m: microphone signal (corresponding to m(n) in FIG. 1);
e: error signal (corresponding to e(n) in FIG. 1); and
$\nabla$: gradient estimate.

The microphone signal m (sum of the incoming signal x and feedback signal y) is modified by audio processing circuit 506 including gain circuitry 508 to produce the loudspeaker signal u. Adaptive filter 510 receives the delayed loudspeaker signal u_d and produces the feedback estimate y_est. The bulk delay represents an initial delay in the feedback path, and may be estimated as a fixed value. An adder 512 subtracts the feedback estimation y_est from the microphone signal m to produce the error signal e, which is amplified by gain circuitry 508 to produce the loudspeaker signal u. Adaptive filter 510 includes filter circuitry 518 to produce the feedback estimate y_est based on the delayed loudspeaker signal u_d, gradient estimator circuitry 514 to produce the gradient estimate ∇ based on the error signal e and the delayed loudspeaker signal u_d, and update filter circuitry 516 to update coefficients of filter circuitry 518 using the gradient estimate ∇ and the delayed loudspeaker signal a_d.

Figure 6:
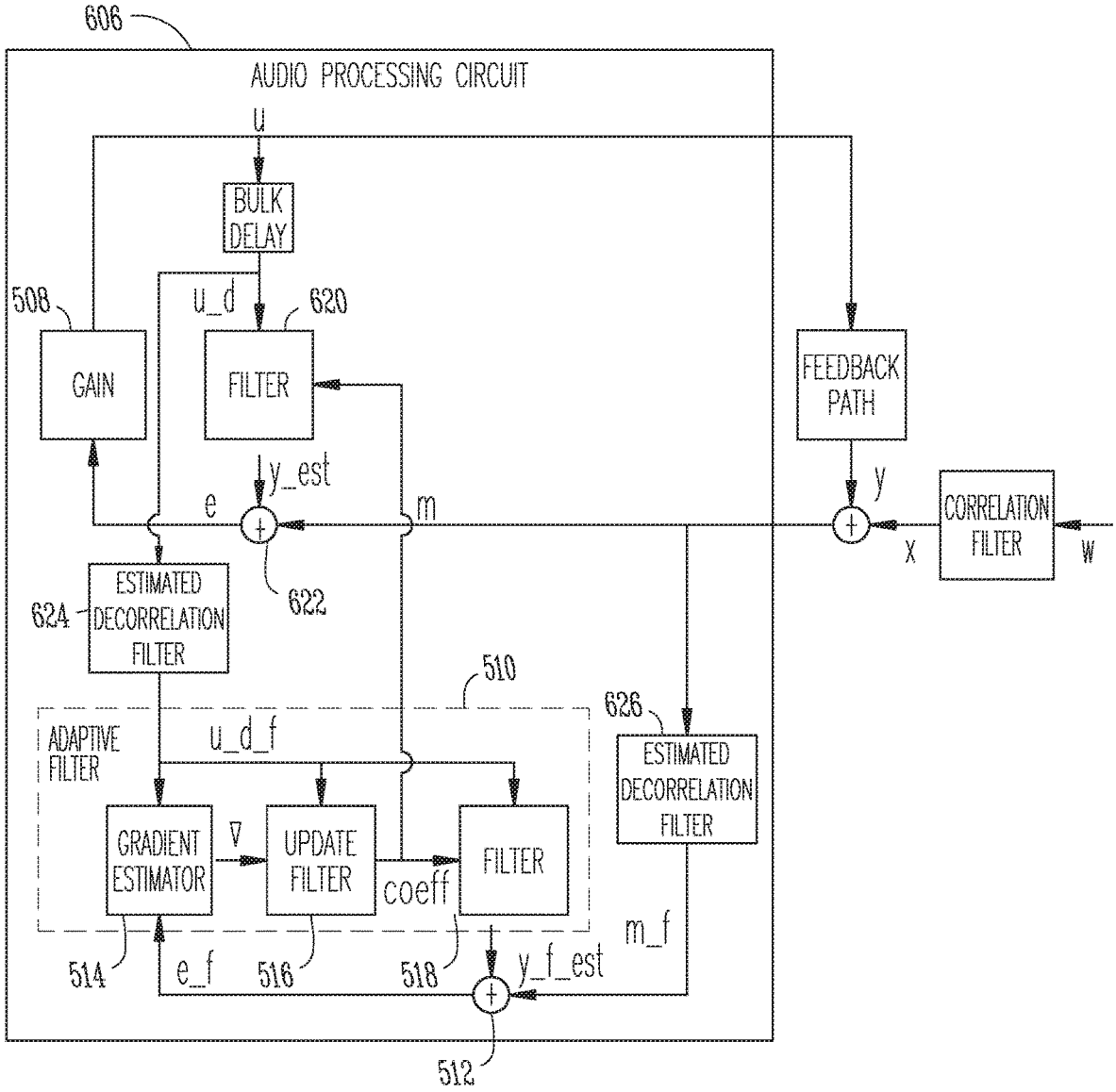
FIG. 6 is a block diagram illustrating an embodiment of an audio processing circuit with adaptive feedback cancellation using prediction error method (PEM).

FIG. 6 is a block diagram illustrating an embodiment of an audio processing circuit with adaptive feedback cancellation using PEM. The PEM addresses the bias problem (entrainment). Other embodiments for addressing the bias problem include, for example, applying output phase modulation (OPM) to the loudspeaker signal output instead of using PEM. A decorrelation method is necessary for normal operation of feedback cancellation. The decorrelation method including its various aspects is discussed, for example, in Guo et al., "On the Use of a Phase Modulation Method for Decorrelation in Acoustic Feedback Cancellation," in *Eur. Signal Process. Conf.*, 2012; Forssell et al., "Closed-loop identification revisited," *Automatica*, vol. 35, no. 7, pp. 1215-1241, 1999; Hellgren, "Analysis of feedback cancellation in hearing aids with Filtered-x LMS and the direct method of closed loop identification," *IEEE Trans. Speech Audio Process.*, vol. 10, no. 2, pp. 119-131, 2002. Spriet et al., "Adaptive feedback cancellation in hearing aids with linear prediction of the desired signal," *IEEE Trans. Signal Process.*, vol. 53, no. 10, pp. 3749-3763, October 2005; Guo et al., "Novel Acoustic Feedback Cancellation Approaches in Hearing Aid. Applications Using Probe Noise and Probe Noise Enhancement," *IEEE Trans. Audio. Speech. Lang. Processing*, vol. 20, no. 9, pp. 2549-2563, November 2012; and Nakagawa et al., "Feedback Cancellation With Probe Shaping Compensation," *IEEE Signal Process. Lett.*, vol. 21, no. 3, pp. 365-369, March 2014, which are incorporated by reference herein in their entireties.

In the illustrated embodiment, an audio processing circuit 606 represents another embodiment of audio processing circuit 106 and includes adaptive filter 510. In addition to those labeled in FIG. 5, signals in FIG. 6 further include:

u_d_f: filtered delayed loudspeaker signal;
m_f: filtered microphone signal;
y_f_est: filtered feedback estimate; and
e_f: filtered error signal.

The microphone signal m (sum of the incoming signal x and feedback signal y) is modified by audio processing circuit 606 including gain circuitry 508 to produce the loudspeaker signal u. A filter 620 receives the delayed loudspeaker signal u_d and produces the feedback estimate y_est. An adder 622 subtracts the feedback estimation y_est from the microphone signal m to produce the error signal e, which is amplified by gain circuitry 508 to produce the loudspeaker signal u. An estimated decorrelation filter 626 filters the microphone signal in to produce the filtered microphone signal m_f. An estimated decorrelation filter 624 filters the delayed loudspeaker signal u_d to produce the filtered delayed loudspeaker signal u_d_f Adaptive filter 510 includes filter circuitry 518 to produce the filtered feedback estimate y_f_est based on the filtered delayed loudspeaker signal u_d_f, gradient estimator circuitry 514 to produce the gradient estimate ∇ based on the filtered error signal e_f and the delayed loudspeaker signal u_d_f, and update filter circuitry 516 to update coefficients of filter circuitry 518 and filter 620 using the gradient estimate ∇ and the delayed loudspeaker signal u_d_f. Adder 512 subtracts the filtered feedback estimation y_f_est from the filtered microphone signal m_f to produce the filtered error signal e_f.

Figure 7:
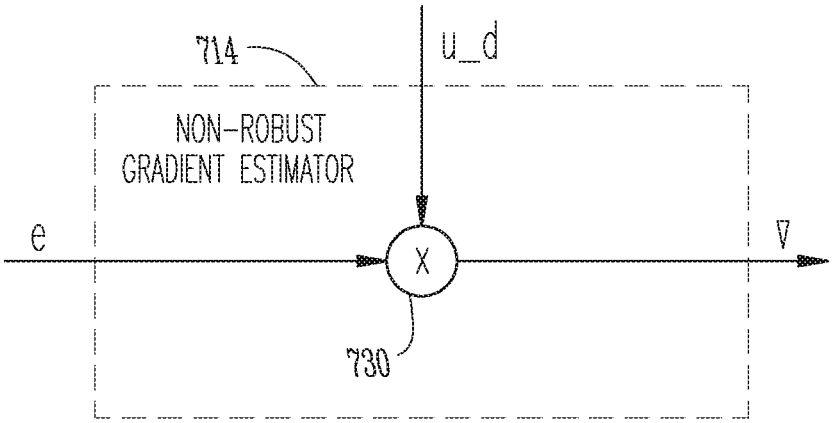
FIG. 7 is a block diagram illustrating an embodiment of a non-robust gradient estimator.
Figure 8:
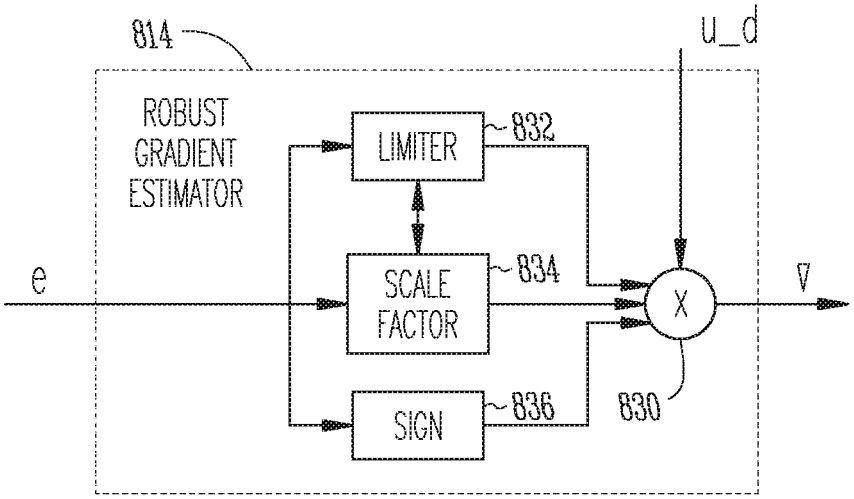
FIG. 8 is a block diagram illustrating an embodiment of a robust gradient estimator.

FIGS. 7 and 8 are each a block diagram illustrating an embodiment of the gradient estimator. FIG. 7 illustrates a non-robust gradient estimator 714, which includes a multiplier 730 to produce the gradient estimate ∇ by multiplying the delayed loudspeaker signal u_d by the error signal. The FIG. 8 illustrates a robust gradient estimator 814, which includes a multiplier 830 to produce the gradient estimate ∇ by multiplying the delayed loudspeaker signal u_d by a processed error signal. The processed error signal is the error signal e processed through limiter circuitry 832 to limit the error signal e, scale factor circuitry 834 to apply a scale factor to the error signal e, and sign circuitry 836 to determine a sign of the error signal (positive or negative), such that the error signal is constrained prior to being used by update filter circuitry 516 to update the coefficients of filter circuitry 518. Gradient estimators 714 and 814 can each represent an example of gradient estimator 514. The gradient estimator is the key figure that differentiates the non-robust from the robust approach. In various embodiments with the robust approach, gradient estimator 814 can be used as gradient estimator 514 in audio processing circuit 606.

In various embodiments, the FBC can be configured by minimizing the following cost function:

$$J = E\left\{\varrho\left(\frac{|e_f(n)|}{s}\right)\right\},$$

Where E{•} is the energy, $\varrho$ (•) is any symmetric function with a monotonically non-decreasing derivative, s is a scale factor, $e_f$ is the pre-whitened error signal (refer to FIG. 6 in the IDEM embodiment where the decorrelation is conducted in a transparent manner). The mean square error cost function is:

$$J=E\{|e_f(n)|^2\}.$$

In one embodiment, the adaptive FBC algorithm follows the steepest-descent method:

$$f(n)=f(n-1)-\mu\bullet\nabla_f J.$$

where f(n) are the filter's coefficient at time n, μ is the step size, and $\nabla_f J$ is the gradient with respect to the filter's coefficients. In other embodiments, the adaptive filter can be implemented according to an RLS, NLMS, Affine Projection (AP), or LMS update rules.

In one embodiment, $\nabla_f J$ is defined as $$\nabla_f J = E\left\{-u_{d_f}(n)\cdot \mathrm{sign}(e_f(n))\cdot \psi\left(\frac{|e_f(n)|}{s}\right)\cdot \frac{1}{s}\right\},$$

where ψ(•) is the limiter (e.g., limiter circuitry 832) and is defined as $$\psi\left(\frac{|e_f(n)|}{s}\right) = \min\left(\frac{|e_f(n)|}{s}, k_0\right),$$

where $k_0$ is a scalar.

The scale factor s is updated as (e.g., for use by scale factor circuitry 834):

$$s(n) = \lambda \cdot s(n-1) + \frac{1-\lambda}{\beta} \cdot s(n-1) \cdot \psi\left(\frac{|e_f(n)|}{s_{n-1}}\right),$$

where λ is a time constant and β is a normalization constant.

In one embodiment, the robust NLMS update (e.g., for use by update filter circuitry 516) is:

$$f(n) = f(n-1) + \frac{\mu}{u_{d_f}^T(n)u_{d_f}(n) + \delta} \cdot u_{d_f}(n) \cdot \psi\left(\frac{|e_f(n)|}{s}\right) \cdot \text{sign}(e_f(n)) \cdot s.$$

In contrast, the non-robust NLMS update is:

$$f(n) = f(n-1) + \frac{\mu}{u_{d_f}^T(n)u_{d_f}(n) + \delta} \cdot u_{d_f}(n) \cdot e_f(n).$$

The illustrated embodiment shows time domain processing that can be performed on a sample-by-same or frame-by-frame basis. Other embodiments can include frequency domain adaptive filters (FDAF). An example of the FDAF is discussed in Shynk, "Frequency-Domain and Multirate Adaptive Filtering", *IEEE SP Magazine*, pp 14-37, January 1992, which is incorporated herein by reference in its entirety. Another example, which uses partitioned block FDAF is discussed in Spriet et al. (2006). In both examples, the error signal is processed in the time domain as discussed above to make the algorithm robust. In still other embodiment, the processing can be performed in subbands. An example is also discussed in Spriet et al. (2006). In this example, the error signal is a complex number (in each subband), which can be handled as discussed above, in one embodiment. In another embodiment, the same equations as presented above can be used to process the real components and the imaginary components of the complex error signal separately.

Some non-limiting examples of the present subject matter are provided as follows:

In Example 1, a method for adaptive acoustic feedback cancellation in an audio device is provided. The method may include applying an optimization criterion determined to enhance robustness of an adaptive feedback canceller against disturbances in an incoming audio signal of the audio device, such that the adaptive feedback controller canceller remains in a converged state in response to presence of the disturbances.

In Example 2, the disturbances as found in Example 1 may optionally include onsets of the incoming audio signal.

In Example 3, the subject matter of any one or any combination of Examples 1 and 2 may optionally further include detecting the onsets of the incoming audio signal and halting an adaptation process of the adaptive feedback canceller in response to each detection of the onsets of the incoming audio signal.

In Example 4, the subject matter of applying the optimization criterion as found in any one or any combination of Examples 1 to 3 may optionally include minimizing a non-quadratic cost function.

In Example 5, the subject matter of applying the optimization criterion as found in Example 4 may optionally include constraining an error signal of the adaptive feedback canceller prior to updating the adaptive feedback canceller using the error signal.

In Example 6, the subject matter of Example 5 may optionally further include applying a prediction error method to whiten the error signal prior to constraining the error signal.

In Example 7, the subject matter of constraining the error signal as found in Example 6 may optionally include limiting and scaling the error signal.

In Example 8, the non-quadratic cost function as found in any one or any combination of Examples 6 and 7 is:

$$J = E\left\{\varrho\left(\frac{|e_f(n)|}{s}\right)\right\},$$

where E{•} is the energy, $\varrho$ (•) is a symmetric function with a monotonically non-decreasing derivative, s is a scale factor, and $e_f$ is the pre-whitened error signal.

In Example 9, a method for operating a processor of an audio device for adaptive acoustic feedback cancellation is provided. The method may include operating an adaptive feedback canceller of the processor in a converged state, detecting an onset of an incoming audio signal received by the audio device, and adjusting the adaptive feedback canceller to maintain the converged state in response to a detection of the onset.

In Example 10, the subject matter of adjusting the adaptive feedback canceller as found in Example 9 may optionally include halting an adaptation process of the adaptive feedback canceller for a period following the detection of the onset.

In Example 11, the subject matter of operating the adaptive feedback canceller as found in any one or any combination of Examples 9 and 10 may optionally include operating an adaptive filter, and the subject flatter of adjusting the adaptive feedback canceller as found in any one or any combination of Examples 9 and 10 may optionally include adjusting the adaptive filter for robustness against the onset of the incoming signal.

In Example 12, the subject matter of Example 11 may optionally include constraining an error signal of the adaptive feedback canceller before the error signal is used to update the adaptive filter.

In Example 13, the subject matter of Example 12 may optionally further include applying a prediction error method to whiten the error signal prior to constraining the error signal.

In Example 14, an audio device may include a microphone, an audio processor, and a loudspeaker. The microphone may be configured to receive an input sound and to produce a microphone signal representative of the received sound. The audio processing circuit may be configured to process the microphone sound to produce a loudspeaker signal, and may include an adaptive feedback canceller. The adaptive filter may be configured to cancel acoustic feedback in the microphone signal and configured to be updated by applying an optimization criterion determined to enhance robustness against disturbances in the microphone signal, such that the adaptive feedback canceller remains convergent in the presence of the disturbances. The loudspeaker may be configured to produce an output sound using the loudspeaker signal.

In Example 15, the subject matter of Example 14 may optionally be configured such that the audio device includes a hearing device.

In Example 16, the subject matter of Example 15 may optionally be configured such that the hearing device includes a hearing aid configured to compensate for hearing impairment.

In Example 17, the subject matter of any one or any combination of Examples 14 to 16 may optionally be configured such that the audio processing circuit includes an adaptive filter. The adaptive filter includes filter circuitry configured to produce a feedback estimate being an estimate of the acoustic feedback in the microphone signal, gradient estimator circuitry configured to constrain an error signal being the microphone signal subtracting the feedback estimate and to produce a gradient estimate using the constrained error signal, and update filter circuitry configured to update coefficients of filter circuitry using the produced gradient estimate.

In Example 18, the subject matter of Example 17 may optionally be configured such that the gradient estimator circuitry includes limiter circuitry configured to limit the error signal, scale factor circuitry configured to apply a scale factor to the error signal, and sign circuitry configured to determine a sign of the error signal.

In Example 19, the subject matter of any one or any combination of Examples 17 and 18 may optionally be configured such that the audio processing circuit is configured to apply a prediction error method to whiten the error signal, and the gradient estimator circuitry is configured to receive and constrain the whitened error signal.

In Example 20, the subject matter of any one or any combination of Examples 14 to 19 may optionally be configured such that the audio processing circuit is configured to detect onsets of the microphone signal and to halt an adaptation process of the adaptive feedback canceller in response to each detection of the onsets.

Hearing devices typically include at least one enclosure or housing, a microphone, hearing device electronics including processing electronics, and a speaker or "receiver." Hearing devices may include a power source, such as a battery. In various embodiments, the battery may be rechargeable. In various embodiments multiple energy sources may be employed. It is understood that in various embodiments the microphone may be optional. It is understood that in various embodiments the receiver may be optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is understood that digital hearing aids include a processor. For example, audio processing circuit 106, 506, and 606, or portions thereof, can each be implemented in such a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

Various embodiments of the present subject matter support wireless communications with a hearing device. In various embodiments the wireless communications can include standard or nonstandard communications. Some examples of standard wireless communications include, but not limited to, Bluetooth™, low energy Bluetooth, IEEE 802.11 (wireless LANs), 802.15 (WPANs), and 802.16 (WiMAX). Cellular communications may include, but not limited to, CDMA, GSM, ZigBee, and ultra-wideband (UWB) technologies. In various embodiments, the communications are radio frequency communications. In various embodiments the communications are optical communications, such as infrared communications. In various embodiments, the communications are inductive communications. In various embodiments, the communications are ultrasound communications. Although embodiments of the present system may be demonstrated as radio communication systems, it is possible that other forms of wireless communications can be used. It is understood that past and present standards can be used. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface. In various embodiments, such connections include all past and present link protocols. It is also contemplated that future versions of these protocols and new protocols may be employed without departing from the scope of the present subject matter.

In various embodiments, the present subject matter is used in hearing devices that are configured to communicate with mobile phones. In such embodiments, the hearing device may be operable to perform one or more of the following: answer incoming calls, hang up on calls, and/or provide two way telephone communications. In various embodiments, the present subject matter is used in hearing devices configured to communicate with packet-based devices. In various embodiments, the present subject matter includes hearing devices configured to communicate with streaming audio devices. In various embodiments, the present subject matter includes hearing devices configured to communicate with Wi-Fi devices. In various embodiments, the present subject flatter includes hearing devices capable of being controlled by remote control devices.

It is further understood that different hearing devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter may be employed in hearing devices, such as hearing aids, headsets, headphones, and similar hearing devices.

The present subject matter may be employed in hearing devices having additional sensors. Such sensors include, but are not limited to, magnetic field sensors, telecoils, temperature sensors, accelerometers and proximity sensors.

The present subject matter is demonstrated for hearing devices, including but not limited to headsets, speakers, cochlear devices, bone conduction devices, personal listening devices, headphones, and hearing aids. Hearing aids include, but not limited to, behind-the-ear (BTE), in-the-ear (ITE), in-the-canal (TTC), receiver-in-canal (RIC or RITE), completely-in-the-canal (CIC), or invisible-in-the-canal (IIC) type hearing aids. It is understood that behind-the-ear type hearing aids may include devices that reside substantially behind the ear or over the ear. Such devices may include hearing aids with receivers associated with the electronics portion of the behind-the-ear device (BTE), or hearing aids of the type having receivers in the ear canal of the user, such as receiver-in-canal (RIC) or receiver-in-the-ear (RITE) designs. The present subject matter can also be used in hearing devices generally, such as cochlear implant type hearing devices. The present subject matter can also be used in deep insertion devices having a transducer, such as a receiver or microphone. The present subject matter can be used in devices whether such devices are standard or custom fit and whether they provide an open or an occlusive design. It is understood that other hearing devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method for adaptive acoustic feedback cancellation in an audio device, comprising:

applying an optimization criterion determined to enhance robustness of an adaptive feedback canceller of the audio device by keeping disturbances in an incoming audio signal of the audio device from resulting in divergence of the adaptive feedback canceller, the adaptive feedback canceller configured to produce an estimate of a feedback signal, the disturbances including onsets of the incoming audio signal of the audio device, the application of the optimization criterion maintaining the adaptive feedback canceller in a converged state in presence of the disturbances, including detecting the onsets of the incoming audio signal using a threshold and adjusting the adaptive feedback canceller using an error signal resulting from subtracting the estimate of the feedback signal from the incoming audio signal in response to each detection of the onsets of the incoming audio signal, wherein adjusting the adaptive feedback canceller using the error signal includes constraining the error signal and updating the adaptive feedback canceller using the constrained error signal.

2. The method of claim 1, further comprising receiving the incoming audio signal from a microphone.

3. The method of claim 2, wherein applying the optimization criterion comprises minimizing a non-quadratic cost function.

4. The method of claim 3, further comprising applying a prediction error method to whiten the error signal prior to constraining the error signal.

5. The method of claim 4, wherein constraining the error signal comprises limiting and scaling the error signal.

6. The method of claim 4, wherein the non-quadratic cost function is:

$$J = E\left\{\varrho\left(\frac{|e_f(n)|}{s}\right)\right\},$$

where $E\{\cdot\}$ is the energy, $\Omega(\cdot)$ is a symmetric function with a monotonically non-decreasing derivative, s is a scale factor, and $e_f(n)$ is the pre-whitened error signal.

7. The method of claim 1, further comprising halting an adaptation process of the adaptive feedback canceller in response to each detection of the onsets of the incoming audio signal.

8. A method for operating a processor of an audio device for adaptive acoustic feedback cancellation, comprising:

operating an adaptive feedback canceller of the processor in a converged state, including producing an estimate of a feedback signal;

producing an error signal by subtracting h estimate of the feedback signal ro an incoming audio signal;

detecting onsets of the incoming audio signal received by the audio device using a threshold; and adjusting the adaptive feedback canceller using the error signal to maintain the adaptive feedback canceller in the converged state in response to a detection of each of the onsets of the incoming audio signal by keeping the detected onset of the incoming audio signal from resulting in divergence of the adaptive feedback canceller, wherein adjusting the adaptive feedback canceller using the error signal includes constraining the error signal and updating the adaptive feedback canceller using the constrained error signal.

9. The method of claim 8, wherein adjusting the adaptive feedback canceller comprises halting an adaptation process of the adaptive feedback canceller for a period following the detection of each of the onsets of the incoming audio signal.

10. The method of claim 9, wherein operating the adaptive feedback canceller comprises operating an adaptive filter, and adjusting the adaptive feedback canceller comprises adjusting the adaptive filter for robustness against each of the onsets of the incoming audio signal.

11. The method of claim 10, further comprising applying a prediction error method to whiten the error signal prior to constraining the error signal.

12. The method of claim 11, wherein constraining the error signal comprises limiting and scaling the error signal.

13. The method of claim 8, further comprising:

receiving the incoming audio signal using a microphone of the audio device;

producing an output signal by processing the incoming audio signal using the processor; and produce an output sound using a loudspeaker of the audio device using the output signal.

14. An audio device, comprising:

a microphone configured to receive an input sound and to produce a microphone signal representative of the received sound;

an audio processing circuit configured to process the microphone sound to produce a loudspeaker signal, the audio processing circuit including an adaptive feedback canceller configured to cancel acoustic feedback in the microphone signal and configured to produce a feedback estimate being an estimate of the acoustic feedback in the microphone signal, to constrain an error signal being a difference between the microphone signal and the feedback estimate, and to be updated using the constrained error signal by applying an optimization criterion determined to enhance robustness by keeping disturbances in the microphone signal from resulting in divergence of the adaptive feedback canceller, the disturbances including onsets of the microphone signal, such that the adaptive feedback canceller remains convergent in the presence of the disturbances, the audio processing circuit configured to detect the onsets of the microphone signal using a threshold and to adjust the adaptive feedback canceller in response to each detection of the onsets of the microphone signal; and a loudspeaker configured to produce an output sound using the loudspeaker signal.

15. The audio device of claim 14, wherein the audio device comprises a hearing device.

16. The audio device of claim 15, wherein the hearing device comprises a hearing aid configured to compensate for hearing impairment.

17. The audio device of claim 14, wherein the audio processing circuit comprises an adaptive filter including:

filter circuitry configured to produce the feedback estimate;

gradient estimator circuitry configured to constrain the error signal and to produce a gradient estimate using the constrained error signal; and update filter circuitry configured to update coefficients of filter circuitry using the produced gradient estimate.

18. The audio device of claim 17, wherein the gradient estimator circuitry comprises:

limiter circuitry configured to limit the error signal;

scale factor circuitry configured to apply a scale factor to the error signal; and sign circuitry configured to determine a sign of the error signal.

19. The audio device of claim 18, wherein the audio processing circuit is configured to apply a prediction error method to whiten the error signal, and the gradient estimator circuitry is configured to receive and constrain the whitened error signal.

20. The audio device of claim 14, wherein the audio processing circuit is configured to halt an adaptation process of the adaptive feedback canceller in response to each detection of the onsets of the microphone signal.

* * * * *